US008938176B2

(12) United States Patent
Xie

(10) Patent No.: US 8,938,176 B2
(45) Date of Patent: Jan. 20, 2015

(54) PRINTING CONSUMABLES CHIPS AND CONTAINERS

(75) Inventor: Ligong Xie, Zhuhai (CN)

(73) Assignee: Print-Rite Technology Development Co., Ltd. of Zhuhai, Zhuhai, Guangdong (CN)

( * ) Notice: Subject to any disclaimer, the term of this patent is extended or adjusted under 35 U.S.C. 154(b) by 0 days.

(21) Appl. No.: 13/976,397

(22) PCT Filed: Jan. 6, 2012

(86) PCT No.: PCT/CN2012/070093

§ 371 (c)(1),
(2), (4) Date: Jun. 26, 2013

(87) PCT Pub. No.: WO2012/092872

PCT Pub. Date: Jul. 12, 2012

(65) Prior Publication Data

US 2013/0279924 A1 Oct. 24, 2013

(30) Foreign Application Priority Data

Jan. 6, 2011 (CN) ..... 2011 1 0002239

(51) Int. Cl.

| | |
|---|---|
| ***G03G 21/14*** | (2006.01) |
| ***G03G 15/00*** | (2006.01) |
| ***B41J 2/175*** | (2006.01) |

(Continued)

(52) U.S. Cl.

CPC ..... *G03G 21/14* (2013.01); *G03G 15/80* (2013.01); *B41J 2/17546* (2013.01); *G03G 15/0863* (2013.01); *G03G 21/1882* (2013.01)

USPC ..... 399/78; 399/12; 399/13; 399/24

(58) Field of Classification Search

CPC .... G03G 15/0863; G03G 15/80; G03G 21/14

USPC ..... 399/12, 13, 78

See application file for complete search history.

(56) References Cited

U.S. PATENT DOCUMENTS 4,594,501 A 6/1986 Culley et al.
5,157,277 A * 10/1992 Tran et al. ..... 327/156

(Continued)

FOREIGN PATENT DOCUMENTS

| | | | | |
|---|---|---|---|---|
| CN | 2901379 | | 5/2007 | |
| CN | 201186534 | * | 1/2009 | ..... G03G 15/08 |
| CN | 101377824 | | 3/2009 | |

(Continued)

*Primary Examiner* — Benjamin Schmitt
(74) *Attorney, Agent, or Firm* — Cozen O'Connor

(57) ABSTRACT

A printing consumables chip comprises a base plate which is provided with a first electrical contact, a second electrical contact, and an electronic module which connects with two electrical contacts. The electronic module comprises a microcontroller, and a clock circuit which provides a clock signal to the microcontroller. The modulation circuit comprises a switch device. A control terminal of the switch device is connected with a first pin of the microcontroller and two output terminals of the switch device are connected with the first electrical contact and the ground, respectively. The clock circuit comprises a comparison unit. A first input terminal of the comparison unit is connected with an external clock signal and a second input terminal. The first pin receives the control signal from the output terminal of the comparison unit, and the control terminal of the switch device is connected with a second pin of the microcontroller.

8 Claims, 4 Drawing Sheets

(51) Int. Cl.
*G03G 21/18* (2006.01)
*G03G 15/08* (2006.01)

(56) References Cited

U.S. PATENT DOCUMENTS 6,565,198 B2 * 5/2003 Saruta et al. ..... 347/86
2005/0095020 A1 * 5/2005 Eom et al. ..... 399/24

FOREIGN PATENT DOCUMENTS

CN 201215613 4/2009
CN 102173206 9/2011
WO WO 2009/127156 10/2009

* cited by examiner

PRINTING CONSUMABLES CHIPS AND CONTAINERS

CROSS-REFERENCE TO RELATED APPLICATIONS

This application claims the priority from international application No. PCT/CN2012/070093 filed on Jan. 6, 2012, which claims priority from Chinese patent application No. 201110002239.9 filed on Jan. 6, 2011. These applications are incorporated herein by reference.

FIELD OF THE INVENTION

The invention relates to the field of printing. More particularly, the invention relates to a printing consumables chip and a printing consumables container which is provided with the printing consumables chip.

TECHNICAL BACKGROUND OF THE INVENTION

Printers are commonly used as office equipment which provides great convenience to modern offices. Existing printers include ink-jet printers and laser printers. Inkjet printers use ink cartridges as printing consumables containers to provide ink to form text or images on paper to be printed, while laser printers use toner cartridges as printing consumables containers to provide toner to form text or images on a printing media.

See FIG. 1. The existing toner cartridge has a case 11. The surroundings of the case 11 form a compartment accommodating the toner. The outer wall of the case is equipped with a chip mounting position 12. The consumables chip 13 is installed on the chip mounting position 12. The consumables chip 13 has a base plate. The base plate is equipped with two electrical contacts 14 and 15 serving as a communication unit which performs data exchange with the laser printer. Further, the other side of the base plate is provided with an electronic module (not shown in FIG. 1) which connects with the electrical contacts 14 and 15. The electronic module has a memory for storing the remaining toner level, the toner cartridge model, the laser printer model for the toner cartridge, and other data.

When toner cartridge is installed on the laser printer, the laser printer will check the consumables chip 13 to determine whether the consumables chip on the toner cartridge is suitable for the laser printer and determine whether the installed toner cartridge can work properly. The laser printer provides the consumables chip 13 with an electronic signal with specific waveform via the two electrical contacts 14 and 15 that represents a specific reading and writing information. The laser printer sends a reading command to the electronic module. After the electronic module receives the reading command, it returns a specific signal via the electrical contacts 14 and 15 to the laser printer. When the electronic module returns information to the laser printer, the waveform of the electrical contacts 14 and 15 is shown in FIG. 2.

The electrical contact 15 receives a clock signal from the laser printer. This clock signal is a reference clock signal and voltages of the high level and low level are 1.8 V and 0 V, respectively (relative to the ground of the printer). The electrical contact 14 receives the level signal from the laser printer 14. When it returns a binary number "0," it performs the signal modulation, and when it returns is a binary number "1" it does not perform the signal modulation.

Only when the reference clock signal is low, does the laser printer receive the returned data. Therefore, when the clock signal received by the electrical contact 15 is low, the electronic module needs to perform signal modulation over the electrical contact 14. As shown in FIG. 2, when the clock signal is a first low level and the first electrical contact 14 is a high level signal, the signal is not modulated, outputting a binary number "1." When the second clock signal is low and the electrical contact 14 is a low level signal, the signal is modulated, outputting a binary number "0", and so on.

The electronic module does not greatly modulate the electrical contact 14 signal, in general, only 0.3 V. Therefore, the voltage of the electrical contact 14 is 5.5 V (relative to the printer ground) at a high level and 5.2 V at low level (relative to the printer ground). After the laser printer receives the electrical signal from the electrical contact 14, it demodulates the electrical signal to obtain corresponding data. The following electrical signals for the contact 15 (or the electrical contact 32) and the electrical contact 14 (or the electrical contact 31) are relative to the printer, and the other signals are relative to the ground of the chip. The ground of the chip is connected with the electrical contact 15 (or the electrical contact 32). Hereafter, the ground means the ground of the chip.

See FIG. 3. The electronic module is connected with the electrical contacts 14 and 15. The electronic module has a power circuit comprising the resistor R1 and capacitor C1. The power circuit supplies electricity to the microcontroller 16. The microcontroller 16 is equipped with a memory that stores information related to the toner cartridge.

The electronic module also comprises a modulation circuit comprising the resistors R4 and R5 and triode Q1. The base electrode of the triode Q1 is connected to the pin IO1 of the microcontroller 16 via resistor R4, and the on-or-off of the triode is controlled by the high or low level output from the pin IO1. The collector of the triode Q1 is connected to the electrical contact 14 via the resistor R5, and the emitter is grounded. When the electronic module outputs a binary number "0", the pin IO1 of the microcontroller 16 outputs a high level, the triode Q1 is turned on, the electrical voltage of the electrical contact 14 is reduced, and therefore, the signal modulation is achieved.

When the electronic module outputs a binary number "1" or when the reference clock signal is high, the pin IO1 outputs a low level signal, the triode Q1 is turned off, and the electrical contact 14 is a high level signal.

The clock circuit of the electronic module comprises the resistors R2 and R3 and the voltage comparator G1. One end of the resistor R3 is connected to the electrical contact 14, and the other end to the point B; one end of the resistor R2 is connected to the electrical contact 15 and the other end to the point B.

The voltage comparator G1 is integrated into the voltage comparator of the microcontroller of 16, its inverting input terminal is connected to the point B via the pin 102 of microcontroller 16, and the non-inverting input terminal is connected to the reference voltage Vref. The reference voltage Vref is the internal reference voltage of the microcontroller 16. The output terminal of the voltage comparator G1 provides a synchronous clock signal to the microcontroller 16.

Because there is a voltage drop between the electrical contacts 14 and 15 and the voltage waveform of the voltage drop is an alternating signal, by selecting appropriate resistance values of the resistors R2 and R3, the voltage at point B can be a high level-low level alternating signal waveform to form a clock signal, for example, a clock signal alternating between 0.8 V and 1.3 V.

Meanwhile, an appropriate voltage in the microcontroller 16 is chosen as a reference voltage Vref of the voltage comparator G1, e.g., the reference voltage Vref can be chosen as 1 V. Because the voltage level of the clock signal inputted to the comparator G1 at point B alternates up or down between the reference voltage Vref, the voltage output terminal of the comparator G1 outputs a clock signal alternating between a high level and a low level and provides this clock signal to the microcontroller 16.

When the modulation circuit modulates the signal output of the electrical contact 14, the voltage of the electrical contact 14 will decrease by 0.3 V, and the voltage of the electrical contact 15 remains unchanged. Because of the voltage division of the resistors R2 and R3, the voltage at point B will correspondently decrease by 0.1 V, and thus it alternates between 0.7 V and 1.2 V. Because the clock signal inputted at point B is still up-down alternating around the reference voltage Vref, the signal outputted by the voltage comparator output G1 remains a high-low alternating clock signal and the amplitude level is consistent with the original.

See FIG. 4. An existing ink cartridge has a case 21; the surroundings of the case 21 form a compartment 25; and the compartment 25 contains the ink. An ink outlet 24 is installed under the case 21; the ink in the compartment 25 can flow out through the ink outlet 24. A consumables chip 23 is installed on the outer wall of the case 21. The structure of the consumables chip is shown in FIG. 5.

The consumables chip 23 comprises a base plate 26. The base plate 26 is provided with several electrical contacts 27. The electrical contact 27 is used as communication unit and is connected with the electrical contacts of the printer to exchange information. The base plate 26 is also provided with an electronic module 28. The electronic module 28 is provided with a memory. The memory stores information relating to the ink cartridge.

The electrical contact 27 includes a date contact and a clock contact. The modulation of the output electrical signal by the electronic module uses the reference clock provided by the inkjet printer as a reference base.

Technical Issues

For the existing cartridge chips, the synchronous clock of the modulation signal from the pin IO1 is the synchronous clock obtained from the output signal of the software detection voltage comparator G1, and thus the synchronization of the modulation signal is low by comparison. That is, the microcontroller 16 cannot modulate the electrical signal of the electrical contact 14 when the reference clock signal is a low level. If the signal modulation is performed when the reference clock is a high level, after the laser printer receives this electrical signal, it is unable to identify this electrical signal. This causes misjudgment of the toner cartridge and affects normal operation of the laser printer.

In addition, the difference in the internal RC clock between different microcontrollers 16 is relatively big, and the discreteness is also relatively big. This results in inconsistency in stability of the consumable chip 13.

Technical Solutions

The main objective of the invention is to provide a consumables chip which has better synchronization between the output signal and the reference clock signal.

Another objective of the invention is to provide a consumables chip, the output signal of which can be correctly identified by the printer.

To achieve the above main objective, the present invention provides a consumable chip which comprises a base plate. The base plate is provided with a first electrical contact, a second electrical contact, and an electronic module which connects with the first electrical contact and the second electrical contact. The electronic module comprises a microcontroller, a power circuit which provides electricity to the microcontroller, and a modulation circuit which modulates the output signal. The modulation circuit comprises a switch device. A control terminal of the switch device is connected with a first pin of the microcontroller and the two output terminals of the switch device are connected with the first electrical contact and the ground, respectively. The electronic module also comprises a clock circuit which provides a clock signal to the microcontroller. The clock circuit comprises a comparison unit. A first input terminal of the comparison unit is connected with an external clock signal and a second input terminal of the comparison unit is connected with a reference voltage. An output terminal of the comparison unit is connected with the microcontroller. According to the invention, the first pin receives the control signal from the output terminal of the comparison unit, and the control terminal of the switch device is connected with a second pin of the microcontroller.

One preferred scheme is that the second contact receives the reference clock signal and the first pin signal and the reference clock signal are inverted.

A further preferred scheme is that the clock circuit is provided with a capacitor which connects in series between the first contact and the first input terminal of the comparison unit.

To achieve the other objective, this invention provides a consumables container. The consumables container comprises a case. The surroundings of the case form a compartment for containing the consumables. The compartment is provided with a consumables outlet. A consumables chip is installed on the outer wall of the compartment. The consumable chip comprises a base plate. The base plate is provided with a first electrical contact, a second electrical contact, and an electronic module which connects with the first electrical contact and the second electrical contact. The electronic module comprises a microcontroller, a power circuit which provides electricity to the microcontroller, and a modulation circuit which modulates the output signal. The modulation circuit comprises a switch device. A control terminal of the switch device is connected with a first pin of the microcontroller and the two output terminals of the switch device are connected with the first electrical contact and the ground, respectively. The electronic module also comprises a clock circuit which provides a clock signal to the microcontroller. The clock circuit comprises a comparison unit. A first input terminal of the comparison unit is connected with an external clock signal and a second input terminal of the comparison unit is connected with a reference voltage. An output terminal of the comparison unit is connected with the microcontroller. According to the invention, the first pin receives the control signal from the output terminal of the comparison unit, and the control terminal of the switch device is connected with a second pin of the microcontroller.

Effectiveness of the Invention

Compared to the current technology, in this invention, the control terminal of the triode in the modulation circuit is connected with the outlet terminal of the comparison unit via the first pin. Therefore, the on-or-off of the triode is controlled by the outlet terminal of the comparison unit. Because the control signal from the comparison unit and the reference clock signal are synchronous, the on-or-off of the triode is also synchronous with the reference clock signal. Thus, in the microcontroller, the first pin is not controlled by the control signal of the software detection control unit, but it is directly connected to the output terminal of the comparison unit to ensure the signal modulation when the reference clock signal is a low level and thus ensures the synchronization of the data output and the reference clock.

The invention is further illustrated by the combination of the figures and embodiments.

EMBODIMENTS OF THE INVENTION

The consumables container of the invention can be an ink cartridge installed on an inkjet printer or a toner cartridge or toner tube installed on a laser printer, a copy machine, or on a fax machine. The invention is illustrated in detail by the following embodiments.

Consumables Chip Embodiment

The consumables chip of this embodiment comprises a base plate. One side of the base plate is provided with two electrical contacts which are used as a communication unit to connect with the electrical contacts of the printer, wherein one electrical contact receives the reference clock signal from the printer, and the other contact is a data contact which receives data from the printer or sends data to the printer.

Figure 1:
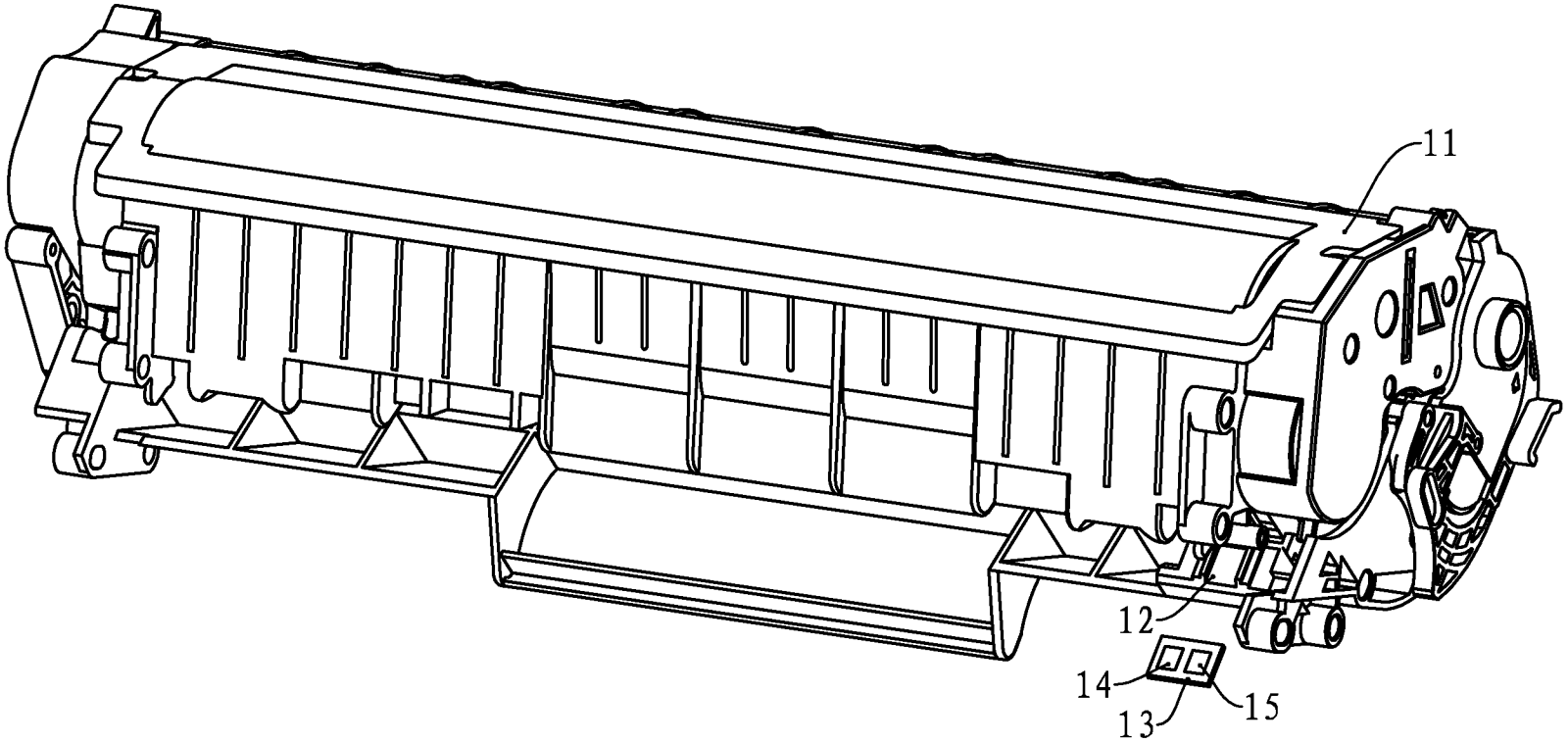
FIG.1 Prior Art
FIG. 1 is an exploded view of the structure of an existing toner cartridge.
Figure 2:
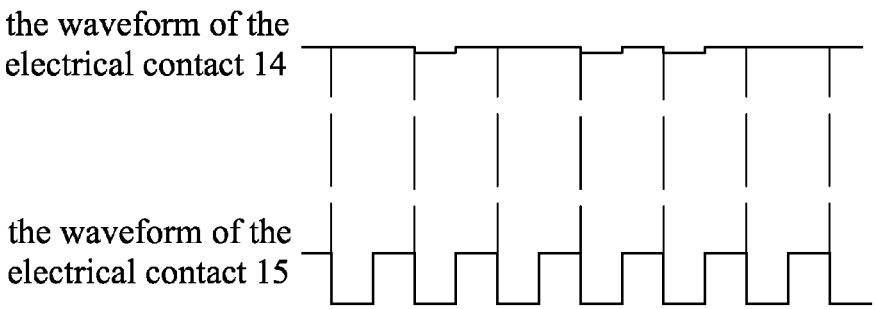
FIG.2 Prior Art
FIG. 2 is the waveforms of the input and output signals of the two electrical contacts when a laser printer and the toner cartridge chip communicate.
Figure 3:
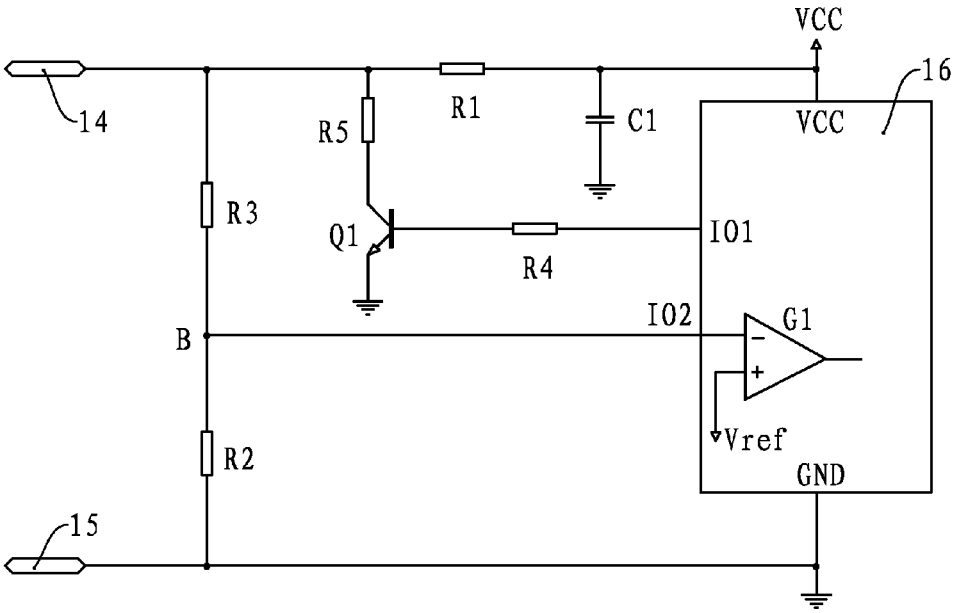
FIG.3 Prior Art
FIG. 3 is a schematic diagram of the electronic module and electrical contacts in an existing toner cartridge.
Figure 4:
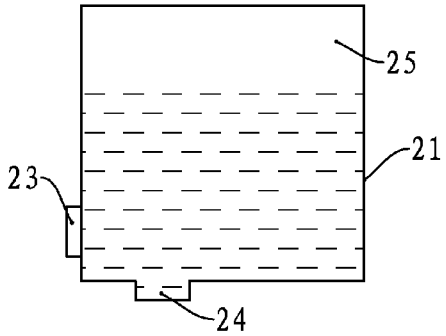
FIG.4 Prior Art
FIG. 4 is a schematic structural view of an existing ink cartridge.
Figure 5:
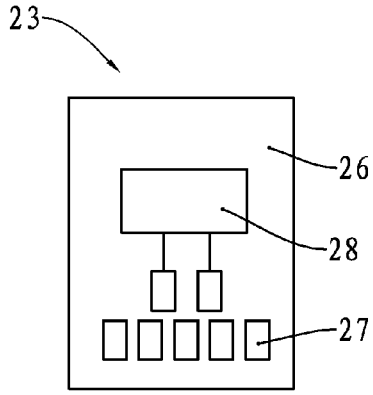
FIG.5 Prior Art
FIG. 5 is a schematic structural view of an existing ink cartridge chip.
Figure 6:
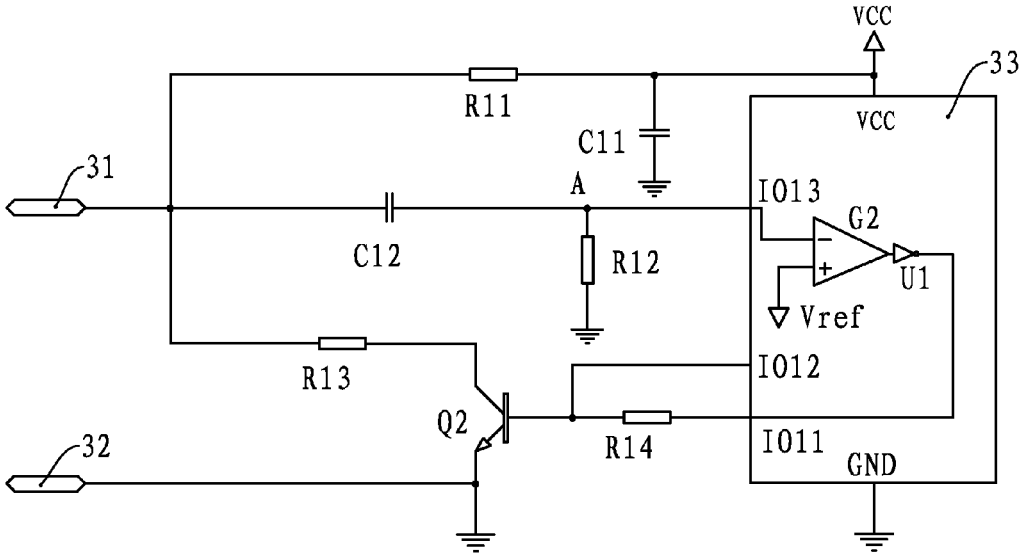
FIG. 6 is an electrical schematic view of the consumables chip embodiment of the invention.
Figure 7:
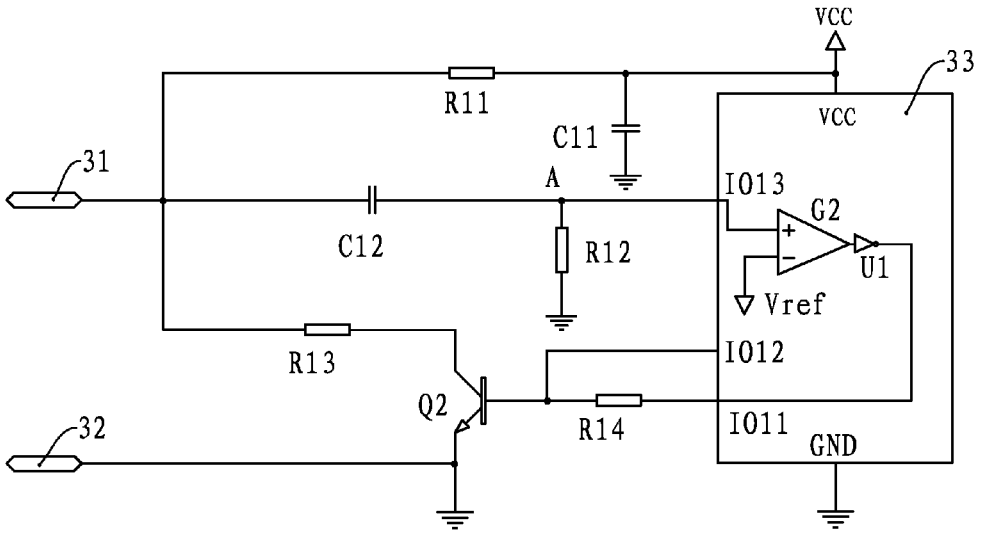
FIG. 7 is an electrical schematic view of the second consumables chip embodiment of the invention.

See FIG. 6. The electronic module is connected with two electrical contacts 31 and 32, wherein the electrical contact 31 is a data contact and it receives the level signal from the printer. This level signal is a high level signal having a voltage of 5.5 V. The contact 32 receives reference clock signals, and the voltages of the high level and low level are 1.8 V and 0 V, respectively.

The electronic module comprises a power circuit which comprises the resistor R11 and capacitor C11. One end of the resistor R11 is connected with the electrical contact 31 to receive electricity supplied by the printer and to supply it to the microcontroller 33. Inside the microcontroller 33 is installed with a memory which stores the data relating to the consumables container, including the remaining level of the consumables.

The electronic module also comprises a clock circuit which comprises the capacitor C12, resistor R12, voltage comparator G2 as a comparison unit, and inverter U1. The capacitor C12 is connected in series between the electrical contact 31 and the inverting input terminal of the voltage comparator G2. One end of the resistor R12 is connected with the pin IO13 of the microcontroller 33, and the other end is grounded. Further, the inverting input terminal of the voltage comparator G2 is connected with the pin IO13 of the microcontroller 33, while the non-inverting input terminal is connected with the reference voltage Vref inside the microcontroller 33.

The output terminal of the voltage comparator G2 is connected with the input terminal of the inverter U1; and the inverter U1 inverts the output signal from the voltage comparator G2 and then sends it to the pin IO11.

Because of the voltage difference between the electrical contacts 31 and 32, the voltage of the electrical contact 31 can be kept around 5.5 V. The electrical contact 32 receives the reference clock signal. The electrical signal varies between the high and low levels. Therefore, the electrical signal at the point A also varies between the high and low levels. Because the capacitor C12 has a function of DC component filtration, after the DC component is filtered from the electrical signal, the electrical signal at the point A is a clock signal varying between 0 V to 1.8 V, and this clock signal is synchronized with the reference clock signal received by the electrical contact 32. Furthermore, the electrical signal at the point A is inverted with the reference clock signal. This is because the voltage at the point A is the electrical signal after the DC component filtration of the voltage of the electrical contacts 31 and 32.

The voltage comparator G2 selects a reference voltage between 0 V and 1.8 V, e.g., 1 V, then the output electrical signal of the voltage comparator G2 is also synchronized with the electrical signal at the point A. However, because the pin IO13 is connected with the inverting input terminal of the voltage comparator, the electrical signal outputted from the voltage comparator G2 is inverting with the electrical signal at the point A, i.e., non-inverting with the reference clock signal.

After the signal outputted from the voltage comparator G2 is treated by the inverter U1, a clock signal which is inverted with the reference clock signal is obtained and outputted to the pin IO11.

The electronic module also comprises a modulation circuit which comprises the triode Q2, resistor R14 and resistor R13. The triode Q2 is a switch device in this embodiment and its base electrode is the control terminal which is connected with the pin IO11 of the microcontroller 33 via the resistor 14. The collection electrode of the triode Q2 is an output terminal which is connected with the electrical contact 31 via the resistor R13. The emitter of the triode Q2 is another output terminal which is grounded.

When the pin IO11 outputs a high level, the triode Q2 is turned on, the electrical signal outputted from the contact 31 is reduced, and thus the outputted electrical signal is modulated. When the pin IO11 outputs a low level, the triode Q2 is turned off, the electrical contact 31 outputs a high level signal, and thus the outputted signal is not modulated. Because the pin IO11 outputs a clock signal which is inverted with the reference clock signal, when the reference clock signal is high, the pin IO11 outputs a low level signal, and the electrical signal of contact 31 is not modulated. Only when the reference clock signal is low, the pin IO11 outputs a high level signal, the triode Q2 is turned on, and thus the electrical signal outputted from the contact 31 is modulated.

In addition, the base electrode of the triode Q2 is connected with the pin IO12 of the microcontroller 33, and the electrical signal outputted from the pin IO12 uses the clock signal outputted from the pin IO11 as a synchronous reference. When the contact 31 outputs a binary number "0", the pin IO12 outputs a high resistance signal to ensure that when the pin outputs a high level, the triode Q2 is turned on and when the pin outputs a low level, the triode Q2 is turned off. When the electrical contact 31 outputs a binary number "1", the pin IO12 outputs a low level; and at this time, though the pin IO11 outputs a high level, the base electrode of the triode Q2 is a low level and the triode Q2 is turned off.

During the half cycle where the reference clock signal is high, the microcontroller 33 decides whether the output signal needs to be modulated during the next half cycle. If the modulation is needed, the pin IO12 outputs a high resistance signal; if the modulation is not needed, it outputs a low level. The signal output of the pin IO12 needs to change during the half cycle where the reference clock signal is high, i.e., during the half cycle where the IO11 is low. Therefore, the microcontroller 33 has sufficient amount of time to determine whether the signal outputted from the pin IO12 is a high resistance signal or a low level. The pin IO12 signal is the signal for the pin IO11 to turn on or turn off. If the IO12 outputs a high resistance signal, the pin IO11 signal directly passes to the modulation circuit to perform modulation. If the IO12 outputs a low level signal, the pin IO11 signal cannot pass to the modulation circuit, and the modulation circuit is turned off.

It can be seen from the above embodiment that the on-or-off of the triode Q2 is controlled by the control signal from the voltage comparator G2, and the signal of the voltage comparator G2 output is synchronized with the reference clock signal. Therefore, the on-or-off switch of the triode Q2 is synchronous with the reference clock signal change ensuring that when the reference clock signal is high, the output electrical signal is not modulated and that the time for the triode Q2 to remain on is within the period during which the reference clock signal is low.

Because the electrical signal of the pin IO11 output is not controlled by the internal software detection inside the microcontroller 33, but is directly controlled by the voltage comparator G2, the on-or-off of the triode Q2 is more precise and the electrical signal of the electrical contact 31 is more synchronous with the reference clock signal so that the data outputted from the consumables chip can be correctly received by the printer.

Toner Cartridge Embodiment

The toner cartridge of this embodiment comprises a case. The surroundings of the case form a compartment for the toner. One end of the toner cartridge is provided with a toner outlet. The outer wall of the case is detachably installed with a consumables chip. The consumables chip is described in the above consumables chip embodiment. The output signal of the consumables chip is synchronized with the reference clock signal and thus the consumables chip has better stability.

Ink Cartridge Embodiment

The ink cartridge of this embodiment comprises a case. The surroundings of the case form a compartment for the ink. Under the compartment is provided with an ink outlet which is connected through with the compartment and the ink can flow out through the ink outlet. The outer wall of the case is detachably installed with a consumables chip. The consumables chip comprises a base plate. The base plate is provided with a data contact and a clock contact. The base plate is also provided with an electronic module which is connected with the data contact and the clock contact. The structure of the electronic module is the same as described in the above consumables chip embodiment, and it is not repeated here.

The above embodiments are illustration of the invention and many variations can be found in practice. For instance, the non-inverting input terminal of the voltage comparator can be connected with the pin IO13, i.e., it is connected with an external clock signal, and the inverting input terminal can be connected with the reference voltage; thus the output terminal of the voltage comparator does not need to be connected with the inverter, and the control signal can be directly outputted to the pin IO11. Alternatively, the control signal outputted from the voltage comparator can be inverted via a program inside the microcontroller instead of through the inverter. Alternatively, if the printer receives data when the reference clock signal is high, the signal outputted from the pin IO11 is synchronized with the reference clock signal, i.e., in the above embodiment the inverter is not needed. All of these changes can be implemented to realize the objectives of the invention.

It should be emphasized that the invention is not limited to the mode of carrying out the embodiments, e.g., the triode can be replaced by a field-effect transistor, and an external voltage comparator instead of an internal voltage comparator can be used. These changes will still fall within the scope of the protection of the invention as claimed.

INDUSTRIAL APPLICABILITY

Compared to the existing technology, in the technical scheme of the invention, the control terminal of the triode of the modulation unit is connected via a pin with the output terminal of the comparison unit, and thus the on-or-off of the triode is controlled by the output terminal of the comparison unit. Because the control signal outputted from the comparison unit is synchronized with the reference clock signal, the on-or-off of the triode can also be synchronized with the reference clock signal. As it can be seen, inside the microcontroller, the pin is directly connected with the output terminal of the comparison unit rather than through the control signal outputted from software detection comparison unit. This ensures that the electrical signal is modulated when the reference clock signal is low and thus that the data output is synchronized with the reference clock.

What is claimed is:

1. A printing consumables chip, comprising:

a base plate which is provided with a first electrical contact, a second electrical contact, and an electronic module which connects with the first electrical contact and the second electrical contact;

wherein the electronic module comprises:

a microcontroller;

a power circuit which supplies electricity to the microcontroller;

a modulation circuit which modulates output signals and comprises a switch device; wherein a control terminal of the switch device is connected with a first pin of the microcontroller and two output terminals of the switch device are connected with the first electrical contact and the ground, respectively;

a clock circuit which provides a clock signal to the microcontroller and comprises a comparison unit; wherein a first input terminal of the comparison unit is connected with an external clock signal, a second input terminal of the comparison unit is connected with a reference voltage source, and an output terminal of the comparison unit is connected with the microcontroller;

wherein the first pin receives the control signal from the output terminal of the comparison unit, and the control terminal of the switch device is connected with a second pin of the microcontroller;

wherein the second electrical contact receives a reference clock signal; and wherein the signal output from the first pin is inverted with the reference clock signal;

wherein the clock circuit further comprises a capacitor which is connected in series between the first electrical contact and the first input terminal of the comparison unit;

wherein the comparison unit is a voltage comparator; the first input terminal is an inverting input terminal of the voltage comparator; the second input terminal is a non-inverting input terminal of the voltage comparator; and the output terminal of the voltage comparator is connected with an input terminal of an inverter.

2. The printing consumables chip of claim 1, wherein the external clock signal is a clock signal provided to a printer.

3. A printing consumables chip, comprising:

a base plate which is provided with a first electrical contact, a second electrical contact, and an electronic module which connects with the first electrical contact and the second electrical contact;

wherein the electronic module comprises:

a microcontroller;

a power circuit which supplies electricity to the microcontroller;

a modulation circuit which modulates output signals and comprises a switch device; wherein a control terminal of the switch device is connected with a first pin of the microcontroller and two output terminals of the switch device are connected with the first electrical contact and the ground, respectively;

a clock circuit which provides a clock signal to the microcontroller and comprises a comparison unit; wherein a first input terminal of the comparison unit is connected with an external clock signal, a second input terminal of the comparison unit is connected with a reference voltage source, and an output terminal of the comparison unit is connected with the microcontroller;

wherein the first pin receives the control signal from the output terminal of the comparison unit, and the control terminal of the switch device is connected with a second pin of the microcontroller;

wherein the second electrical contact receives a reference clock signal; and wherein the signal output from the first pin is inverted with the reference clock signal;

wherein the clock circuit further comprises a capacitor which is connected in series between the first electrical contact and the first input terminal of the comparison unit;

wherein the comparison unit is a voltage comparator; the first input terminal is a non-inverting input terminal of the voltage comparator; and the second input terminal is an inverting input terminal of the voltage comparator.

4. The printing consumables chip of claim 3, wherein the external clock signal is a clock signal provided to a printer.

5. A printing consumables container, comprising:

a case, the surroundings of which form a compartment accommodating the printing consumables; wherein a consumables outlet is provided on the compartment, wherein a printing consumables chip is installed on the outer wall of the compartment, and wherein the printing consumables chip comprises a base plate which is provided with a first electrical contact, a second electrical contact, and an electronic module which connects with the first electrical contact and the second electrical contact;

wherein the electronic module comprises:

a microcontroller;

a power circuit which supplies electricity to the microcontroller;

a modulation circuit which modulates output signals and comprises a switch device; wherein a control terminal of the switch device is connected with a first pin of the microcontroller and two output terminals of the switch device are connected with the first electrical contact and the ground, respectively;

a clock circuit which provides a clock signal to the microcontroller and comprises a comparison unit; wherein a first input terminal of the comparison unit is connected with an external clock signal, a second input terminal of the comparison unit is connected with a reference voltage source, and an output terminal of the comparison unit is connected with the microcontroller;

wherein the first pin receives the control signal from the output terminal of the comparison unit, and the control terminal of the switch device is connected with a second pin of the microcontroller;

wherein the second electrical contact receives a reference clock signal; and wherein the signal output from the first pin is inverted with the reference clock signal;

wherein the clock circuit further comprises a capacitor which is connected in series between the first electrical contact and the first input terminal of the comparison unit:

wherein the comparison unit is a voltage comparator; the first input terminal is an inverting input terminal of the voltage comparator; the second input terminal is a non-inverting input terminal of the voltage comparator; and the output terminal of the voltage comparator is connected with an input terminal of an inverter.

6. The printing consumables container of claim 5, wherein the external clock signal is a clock signal provided to a printer.

7. A printing consumables container, comprising:

a case, the surroundings of which form a compartment accommodating the printing consumables; wherein a consumables outlet is provided on the compartment, wherein a printing consumables chip is installed on the outer wall of the compartment, and wherein the printing consumables chip comprises a base plate which is provided with a first electrical contact, a second electrical contact, and an electronic module which connects with the first electrical contact and the second electrical contact;

wherein the electronic module comprises:

a microcontroller;

a power circuit which supplies electricity to the microcontroller;

a modulation circuit which modulates output signals and comprises a switch device; wherein a control terminal of the switch device is connected with a first pin of the microcontroller and two output terminals of the switch device are connected with the first electrical contact and the ground, respectively;

a clock circuit which provides a clock signal to the microcontroller and comprises a comparison unit; wherein a first input terminal of the comparison unit is connected with an external clock signal, a second input terminal of the comparison unit is connected with a reference voltage source, and an output terminal of the comparison unit is connected with the microcontroller;

wherein the first pin receives the control signal from the output terminal of the comparison unit, and the control terminal of the switch device is connected with a second pin of the microcontroller;

wherein the second electrical contact receives a reference clock signal; and wherein the signal output from the first pin is inverted with the reference clock signal;

wherein the clock circuit further comprises a capacitor which is connected in series between the first electrical contact and the first input terminal of the comparison unit;

wherein the comparison unit is a voltage comparator; the first input terminal is a non-inverting input terminal of the voltage comparator; and the second input terminal is an inverting input terminal of the voltage comparator.

8. The printing consumables container of claim 7, wherein the external clock signal is a clock signal provided to a printer.

* * * * *